US006662514B2

(12) United States Patent
Workman

(10) Patent No.: US 6,662,514 B2
(45) Date of Patent: Dec. 16, 2003

(54) IMPALEMENT PROTECTION SAFETY SYSTEM

(75) Inventor: Gary Workman, Lombard, IL (US)

(73) Assignee: Deslauriers, Inc., Bellwood, IL (US)

( * ) Notice: Subject to any disclaimer, the term of this patent is extended or adjusted under 35 U.S.C. 154(b) by 102 days.

(21) Appl. No.: 09/928,670

(22) Filed: Aug. 13, 2001

(65) Prior Publication Data

US 2002/0112426 A1 Aug. 22, 2002

Related U.S. Application Data

(60) Provisional application No. 60/269,952, filed on Feb. 20, 2001.

(51) Int. Cl.[7] ..... E04C 5/16

(52) U.S. Cl. ..... 52/300; 52/301; 52/698; 256/DIG. 6

(58) Field of Search ..... 52/698, 300, 301, 52/741.3, 749.1, DIG. 12; 256/11, 59, DIG. 6; 138/96 R

(56) References Cited

U.S. PATENT DOCUMENTS 5,613,336 A * 3/1997 Workman ..... 52/301
5,826,398 A * 10/1998 Carnicle ..... 52/698
5,887,394 A * 3/1999 Workman ..... 52/301
5,943,836 A * 8/1999 Kassardjian ..... 52/301
6,073,415 A * 6/2000 Carnicle ..... 52/698
6,085,478 A * 7/2000 Workman ..... 52/301
6,199,333 B1 * 3/2001 Viduka, Jr. ..... 52/300

* cited by examiner

*Primary Examiner*—Carl D. Friedman
*Assistant Examiner*—Jennifer I. Thissell
(74) *Attorney, Agent, or Firm*—Wood, Phillips, Katz, Clark & Mortimer

(57) ABSTRACT

Broadly, there is disclosed herein in accordance with a first aspect of the invention a safety system for use with linearly arranged reinforcement bars. The safety system includes a plurality of safety covers and a plurality of adapters. Each safety cover includes a cover plate and a collar operatively associated with and extending downwardly from the cover plate for mounting to an upper end of a reinforcement bar. Each adapter has a center section and opposite upwardly turned side sections defining a channel. The center section is adapted to removably receive one of the safety covers to secure the adapter to the reinforcement bar. The channel receives an elongate body extending between two or more of the adapters on linearly arranged reinforcement bars.

20 Claims, 4 Drawing Sheets

IMPALEMENT PROTECTION SAFETY SYSTEM

CROSS-REFERENCE

This application claims priority of Provisional Application No. 60/269,952, filed Feb. 20, 2001.

BACKGROUND OF THE INVENTION

Presently, it is known to use protective caps on exposed ends of individual reinforcement bars used in the construction industry. Typically, the caps have a "mushroom" shape. These caps are designed to prevent the various injuries that can occur through accidental contact with the exposed ends of the reinforcement bars. These caps are generally successful in preventing assorted minor injuries that can arise through contact with the exposed ends of reinforcement bars. More serious injuries which can occur by forceful impacts with the exposed ends of reinforcement bars may not be adequately addressed by the caps, such as when a worker at a construction site falls from an elevated work platform onto the cap covering the exposed end of a reinforcement bar. Workers who fall onto these reinforcement bars having caps thereon are still at a serious risk of being impaled.

Various impalement protection devices have been used. One is a safety cover that consists of a relatively large cover plate operatively secured to a collar that mounts to an upper end of a reinforcement bar. Often, a steel insert is included to prevent the reinforcement bar from penetrating the cover plate. One version of such a safety cover includes a safety cap that snap-fits to a mushroom type protective cap with a steel insert therebetween. Other versions provide a one-piece cover plate and collar.

Still other alternatives exist for providing impalement protection with linearly arranged reinforcement bars. One known product uses a guardrail for guarding reinforcement bars including a housing with structure for capturing the reinforcement bars therein. Still other alternatives include a safety cover-like device with upwardly extending sidewalls for capturing a 2"×4" piece of lumber over linearly arranged reinforcement bars.

All of the various options described require maintaining an inventory of numerous different products specific to each particular application. Moreover, some of the products can be difficult and expensive to manufacture.

The present invention is directed to further improvements in safety systems for use with linearly arranged reinforcement bars.

SUMMARY OF THE INVENTION

In accordance with the invention there is provided a safety system for use with linearly arranged reinforcement bars including an adapter removably received on a safety cover.

Broadly, there is disclosed herein in accordance with a first aspect of the invention a safety system for use with linearly arranged reinforcement bars. The safety system includes a plurality of safety covers and a plurality of adapters. Each safety cover includes a cover plate and a collar operatively associated with and extending downwardly from the cover plate for mounting to an upper end of a reinforcement bar. Each adapter has a center section and opposite upwardly turned side sections defining a channel. The center section is adapted to removably receive one of the safety covers to secure the adapter to the reinforcement bar. The channel receives an elongate body extending between two or more of the adapters on linearly arranged reinforcement bars.

In accordance with one embodiment of the invention the adapter center section includes a through opening whereby the cover plate of one of the safety covers is disposed in the channel and the collar extends downwardly through the opening to removably receive one of the safety covers.

In accordance with another embodiment of the invention the adapter center section includes opposite downwardly extending support members and the cover plate of one of the safety covers is supported between the support members to removably receive the one of the safety covers.

It is a feature of the invention that the side sections include a plurality of openings for receiving fasteners to fasten the elongate body to the adapter. The side sections may include inwardly extending bosses surrounding each opening.

It is another feature of the invention that each adapter includes tabs hingedly mounted to and extending upwardly from the side sections for attaching to the top of the elongate body.

It is a further feature of the invention that the side sections include inwardly extending ribs.

It is still another feature of the invention that the center section includes upwardly extending pins receivable in openings in the cover plate to snap-fit the adapter to one of the safety covers.

It is still a further feature of the invention that each adapter is of one-piece plastic construction.

It is yet another feature of the invention that each adapter comprises a generally planar elongate plate having a pair of laterally extending grooves to define living hinges between the center section and the side sections and the side sections are folded upwardly about the living hinges to define the channel.

There is disclosed in accordance with another aspect of the invention an adapter for supporting an elongate body above linearly arranged reinforcement bars in a safety system, the safety system including a plurality of safety covers, one for each linearly arranged reinforcement bar. Each safety cover includes a cover plate and a collar operatively associated with and extending downwardly from the cover plate for mounting to an upper end of one of the reinforcement bars. The adapter comprises a center wall connected to opposite upwardly turned side walls to define a channel, the channel for receiving an elongate body extending between two or more of the adapters on linearly arranged reinforcement bars. Securing means are operatively associated with the center wall for removably securing the adapter to one of the safety covers.

Further features and advantages of the invention will be readily apparent from the specification and from the drawings.

DETAILED DESCRIPTION OF THE INVENTION

Figure 1:
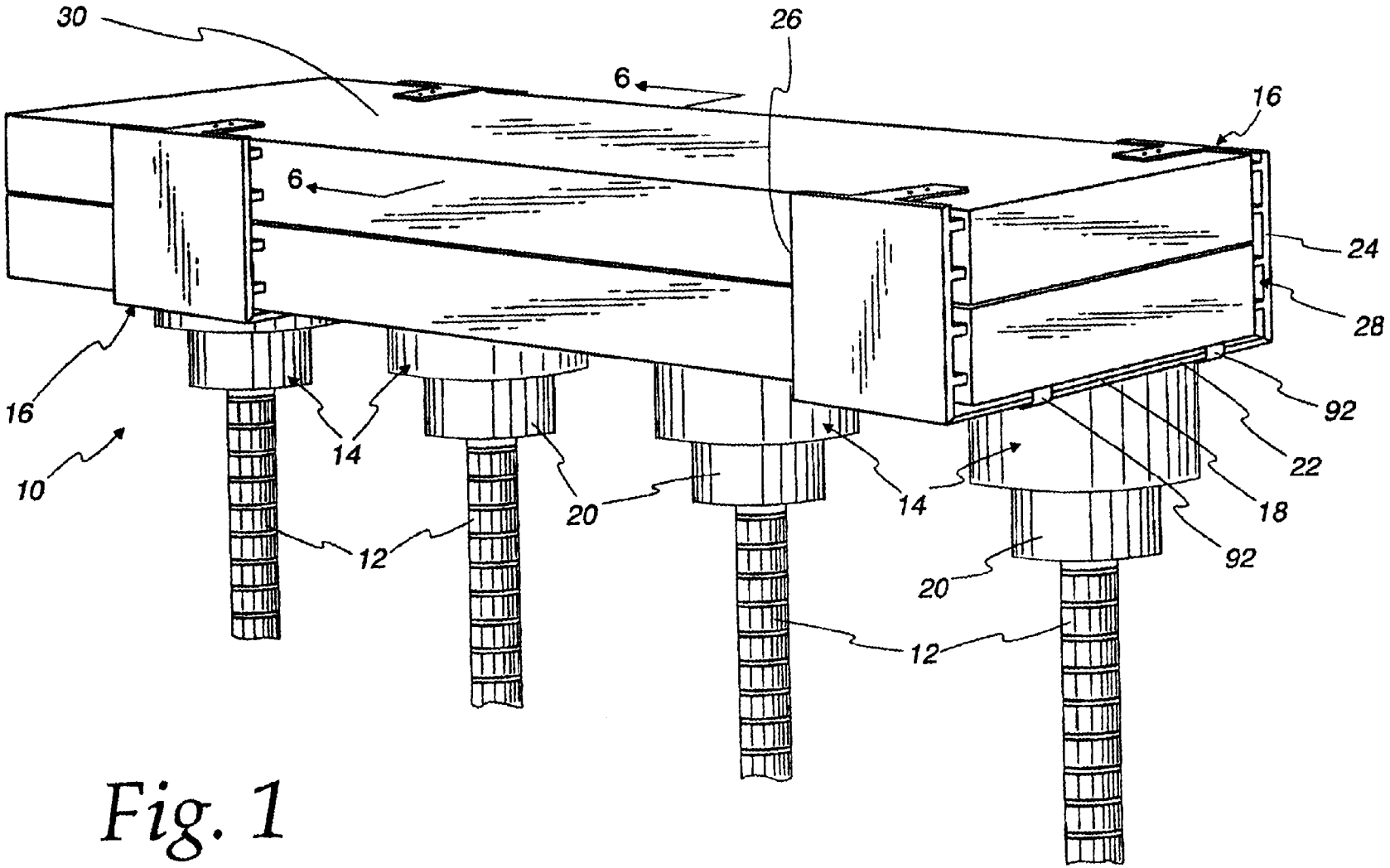
FIG. 1 is a perspective view of a safety system in accordance with the invention for use with linearly arranged reinforcement bars.

Referring to FIG. 1, a safety system 10 is illustrated for use with linearly arranged reinforcement bars, also known as rebars, 12. The safety system 10 includes a plurality of safety covers 14 and a plurality of adapters 16.

Each safety cover 14 includes a cover plate 18 and a collar 20. The collar 20 is operatively associated with and extends downwardly from the cover plate 18 for mounting to an upper end of one of the reinforcement bars 12. Each adapter 16 has a center section 22 and opposite upwardly turned side sections 24 and 26 defining a channel 28. The center section 22 is adapted to removably receive one of the safety covers 20 to secure the adapter 16 to the reinforcement bar 12. The channel 28 is adapted for receiving an elongate body 30 extending between two or more of the adapters 16 on the linearly arranged reinforcement bars 12. In the illustrated embodiment of the invention, the elongate body 30 comprises 2"×4" lumber. Alternatively, the elongate body 30 could include a 4"×4" beam of lumber or be of other material.

In the illustrated embodiment of the invention, the adapter 16 can be mounted on the reinforcement bars 12 at four-foot increments, to satisfy requirements for California OSHA regulations. Thus, the safety covers 14 and adapters 16 support the 2"×4" lumber 30 which spans the four foot distance and provides protection against impalement. In the illustrated embodiment, safety covers 14 are includes atop each of the reinforcement bars 12. However, adapters 16 are only provided at four-foot increments. As such, the safety covers 14 without the adapters 16 support the elongate body 30 from below while the adapters 16 retain the elongate body 30 atop the safety covers 14.

In the illustrated embodiment of the invention, the safety cover 14 comprises a safety cap system such as described in my U.S. Pat. Nos. 5,887,394 and 5,613,336, the specifications of which are hereby incorporated by reference herein. Alternatively, the safety cover could be manufactured in accordance with the various embodiments illustrated in my U.S. Pat. No. 6,085,478, the specification of which is also incorporated by reference herein. These different embodiments generally consist of a rebar cap for mounting to the reinforcement bar, a steel insert and a cover which is snap-fit onto the cap. Alternatively, the cap may be permanently joined to the cover subsequent to manufacturing or the cap and cover can be an integrally molded unit with or without a steel insert, as will be apparent to those skilled in the art. The particular form of the safety cover is not critical to the claimed invention. Instead, the invention contemplates an adapter removably secured to a safety cover for supporting the elongate body.

Figure 2:
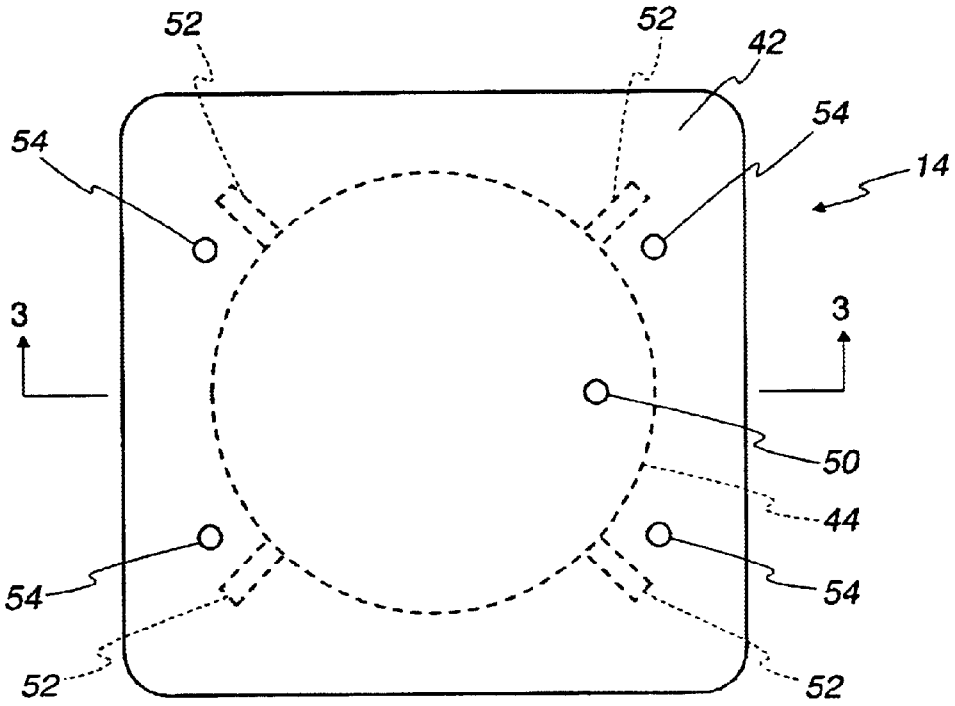
FIG. 2 is a top plan view of a safety cover used with the safety system of FIG. 1.
Figure 3:
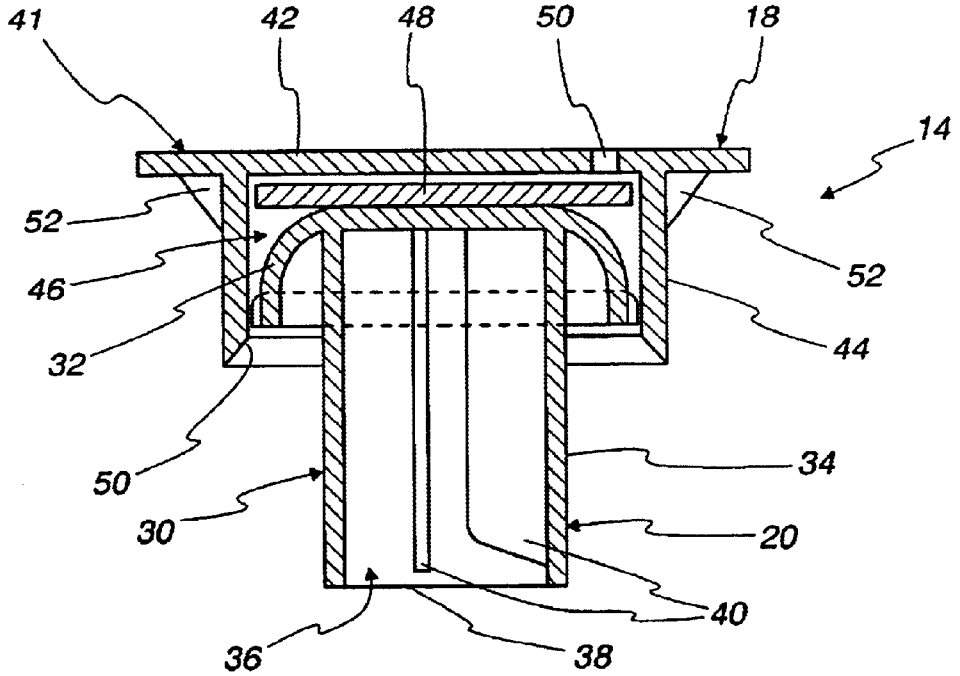
FIG. 3 is a sectional view taken along the line 3—3 of FIG. 2.

Referring to FIGS. 2 and 3, the exemplary safety cover 14 is illustrated in greater detail. A protective cap 30 has a mushroom shaped head 32 and a cylindrical body 34 defining the collar 20. The head 32 closes one end of the cylindrical body 34. The cylindrical body 34 defines an interior space 36 accessible through an open end 38 for receiving the reinforcement bar 12, see FIG. 1. A fin assembly 40 extends into the interior space 36 to frictionally engage and surround the upper end of the reinforcement bar 12 in a conventional manner to securely maintain the protective cap 30 over the reinforcement bar 12.

A cover includes a generally planar top wall 42 which is approximately 4"×4" square defining the cover plate 18. A skirt 44 depends downwardly from the top wall 42 and defines a receptacle 46 for receiving a steel insert 48. An inwardly directed circumferential projection 50 extends around the skirt 44 opposite the cover plate 42 to capture the protective cap head 32 with the steel insert 48 sandwiched between the head 32 and the top wall 42. An opening 50 is provided through the top wall 42 within the skirt 44 to verify that the steel insert 48 is in place. Support fins 52 are operatively connected to the skirt 44 and top wall 42 to support the top wall 42.

Although not shown, the protective cap 32 could be integrally fused to the skirt 44 at the circumferential projection 50.

The safety cover 14 as described above is generally similar to that described in U.S. Pat. Nos. 5,613,336 and 5,887,394 incorporated by reference herein. The safety cover described therein is modified in accordance with the invention by the addition of four through openings 54 through the top wall 42 around the periphery of the skirt 44.

Figure 4:
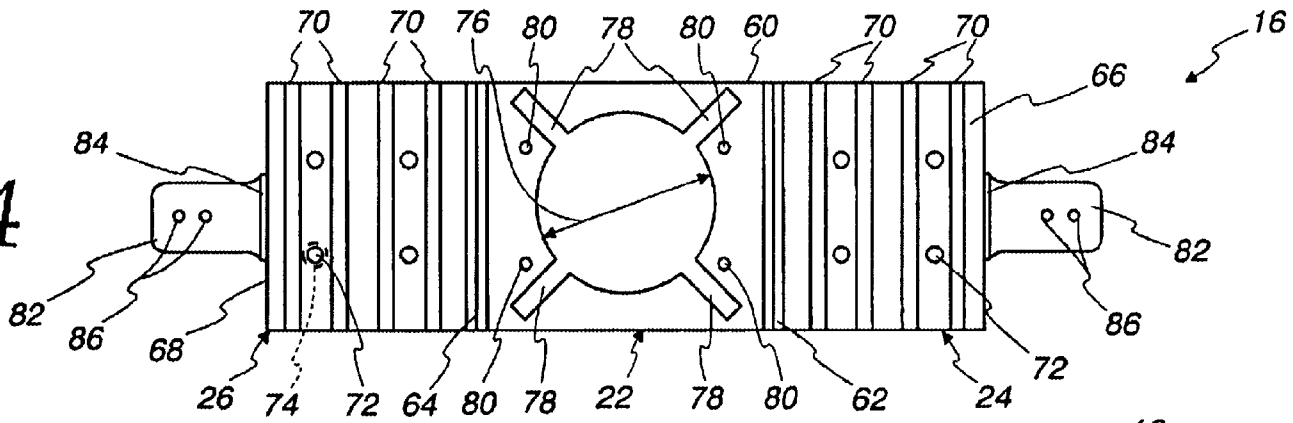
FIG. 4 is a top plan view of an adapter used with the safety system of FIG. 1.
Figure 5:
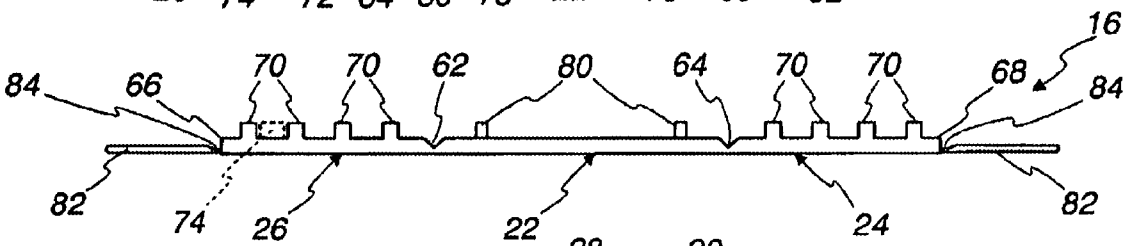
FIG. 5 is a side elevation view of the adapter of FIG. 4.

Referring to FIGS. 4 and 5, the adapter 16 is illustrated in greater detail. The adapter is manufactured of one-piece molded plastic and comprises a generally planar elongate rectangular plate 60. The plate 60 has a pair of laterally extending first and second grooves 62 and 64 equally spaced from its respective first and second ends 66 and 68. The grooves 62 and 64 are V-shaped to define living hinges. The center section, or center wall, 22 is disposed between the grooves 62 and 64 and is approximately 4" square corresponding to the size of the cover plate 18, as discussed above. The first side section, or side wall, 24 is disposed between the first hinge 62 and the first end 66. Similarly, the second side section, or side wall, 26 is disposed between the second groove 64 and the second end 68. The length of the side walls 24 and 26 is approximately 3¼", approximately the height of two 2"×4"s and the thickness of the cover plate 18. Thus, the side walls 24 and 26 are folded up about the hinges 62 and 64, respectively, to define the channel 28, see FIG. 1, to capture the elongate beam 30 therebetween.

Each side wall 24 and 26 includes four laterally extending ribs 70. A plurality of nail openings 72 are provided through the side walls 24 and 26 between individual pairs of the ribs 70, as shown. A boss 74 may optionally be included surrounding the openings 72, as illustrated in phantom for one of the through openings 72. The height of the boss 74 corresponds to the height of the ribs 70.

The center wall 22 includes a circular through opening 76 which is of a size slightly larger than the safety cover skirt 44. Radially extending rectangular openings 78 surround and are connected to the circular openings 76. Four pins or posts 80 extend upwardly from the center wall 22 surrounding the circular openings 76. Particularly, the size and location of the rectangular openings 70 corresponds to the circumferential position of the radial fins 52 of the cover 41. Similarly, the position of the pins 80 corresponds to the position of the cover plate openings 54, see FIG. 2.

The adapter 16 further includes tabs 82 extending from the ends 66 and 68. The tabs 82 are hingedly connected to the plate 60 via living hinges 84. Particularly, the tabs 82 are integrally formed with the plate 60. Each tab 82 includes pair of through openings 86.

In use, the safety cover 14 is removably secured to the adapter center wall 22 by inserting the collar and skirt 44 downwardly through the opening 76 with the fins 52 received in the rectangular opening 78. The four pins 80 snap-fit into the openings 54. As is apparent, the adapter 16 could be removed from the safety cover 14 for replacement or storage or the like upon completion of the work.

Figure 6:
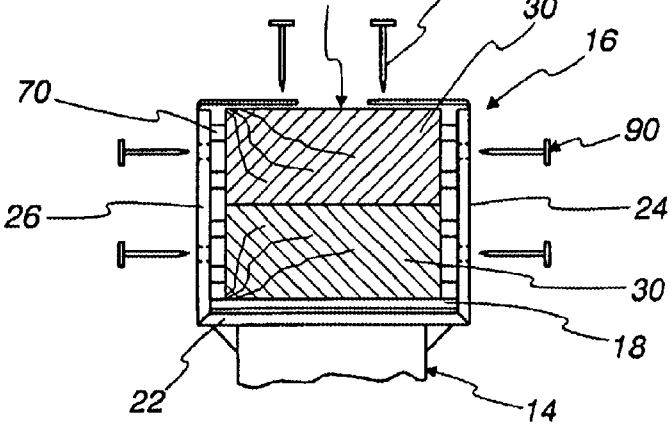
FIG. 6 is a sectional view taken along the line 6—6 of FIG. 1.

With the safety cover 14 removably secured to the adapter 16, the side walls 24 and 26 are folded upwardly about the hinges 62 and 64 to define the channel 28. The elongate body 30, i. e., the stacked 2"×4"s, can then be placed in the channel 28, as shown in FIGS. 1 and 6. As is known, the 2"×4" lumber is actually 3½" across. Owing to the 4-inch size of the cover plate 18, the ribs 70 fill in the space between the side walls 24 and 26 and the lumber. Nails 90, or other suitable fasteners, can then be hammered through the opening 72 into the sides of the elongate body 30 to secure it to the adapter 16. Additional nails 90 can be used through the tab openings 86 to permit the adapter to be nailed to the elongate body 30 from the top.

In addition to, or instead of, the pins 80 received in the openings 54, the safety cover 14 can be further secured retained in the adapter 16 using rubber bands 92, see FIG. 1. The rubber bands 92 may be UV-protected rubber bands.

As a still further alternative, the safety cover 14 could be force-fit within the opening 76 to maintain the adapter 16 in assembled relation with the safety cover 14. In any of these versions, the safety cover 14 is essentially removably secured to the adapter 16 by having the cover plate 18 within the channel 28 sandwiched between the center wall 22 and the elongate body 30.

In the illustrated embodiment of the invention, the safety cover skirt 44 is operativelly associated with the collar 20 via the interconnection between the skirt 44 and head 32. More broadly, the skirt 44 can be considered as forming a portion of the collar 20 with the specific configuration of the collar 20 depending on the specific configuration of the safety cover 14. Particularly, as broadly comprehended, the collar is generally wider in the area that supports the cover plate 18 and generally narrower at the portion receiving the reinforcement bar 12 to securely maintain the safety cover on the reinforcement bar 12 and to properly support the cover plate 18.

Figure 7:
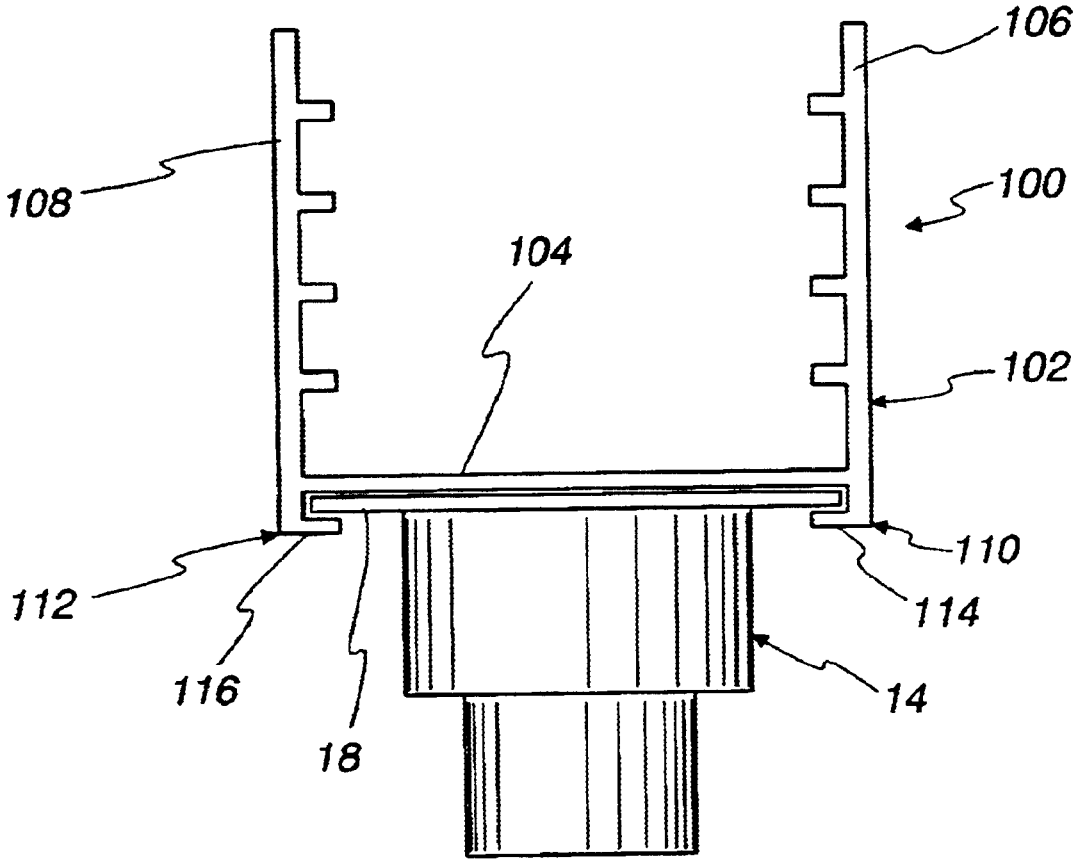
FIG. 7 is an end elevation view of a safety system in accordance with an alternative embodiment of the invention.

Referring to FIG. 7, a safety system 100 in accordance with an alternative embodiment of the invention is illustrated. The safety system 100 uses the safety cover 14 described above relative to FIGS. 2 and 3 along with an adapter 102. The adapter 102 includes a center section or center wall 104 disposed between opposite upwardly extending side sections or side walls 106 and 108. In this embodiment, the center wall 104 does not include an opening for removably securing the adapter to the safety cover. Instead, opposite support members 110 and 112 extend downwardly from the center wall 104 below the respective side walls 106 and 108. Each support member 110 and 112 comprises an extension to the associated side wall 106 and 108 below the center wall 104 and an inwardly turned flange 114 and 116. The adapter 102 is removably secured to the safety cover 14 by sliding the cover plate 18 below the center wall 104 between the support members 110 and 112 to be supported from below by the flanges 114 and 116. As with the embodiment above, rubber bands (not shown) could be used to further maintain the adapter 102 and safety cover 14 in assembled relation. The adapter 102 comprises an extruded part. Nevertheless, the adapter 102 could be formed by other means.

Thus, in accordance with the invention, there is provided a safety system including an adapter removably secured to a safety cover for use with linearly arranged reinforcement bars.

I claim:

1. A safety system for use with linearly arranged reinforcement bars comprising:

a plurality of safety covers, each safety cover including a cover plate and a collar operatively associated with and extending downwardly from the cover plate for mounting to an upper end of a reinforcement bar; and a plurality of adapters, each adapter having a center section and opposite upwardly turned side sections defining a channel, the center section being adapted to removably receive one of the safety covers to secure the adapter to a reinforcement bar, the channel for receiving an elongate body extending between two or more of the adapters on linearly arranged reinforcement bars.

2. The safety system of claim 1 wherein the adapter center section includes a through opening whereby the cover plate of one of the safety covers is disposed in the channel and the collar extends downwardly through the opening to removably receive the one of the safety covers.

3. The safety system of claim 1 wherein the adapter center section includes opposite downwardly extending support members and the cover plate of one of the safety covers is supported between the support members to removably receive the one of the safety covers.

4. The safety system of claim 1 wherein the side sections include a plurality of openings for receiving fasteners to fasten the elongate body to the adapter.

5. The safety system of claim 4 wherein the side sections include inwardly extending bosses surrounding each opening.

6. The safety system of claim 1 wherein each adapter includes tabs hingedly mounted to and extending upwardly from the side sections for attaching to a top of the elongate body.

7. The safety system of claim 1 wherein the side sections include inwardly extending ribs.

8. The safety system of claim 1 wherein the center section includes upwardly extending pins receivable in openings in the cover plate to snap fit the adapter to one of the safety covers.

9. The safety system of claim 1 wherein each adapter is of one piece plastic construction.

10. The safety system of claim 1 wherein each adapter comprises a generally planar elongate plate having a pair of laterally extending grooves to define living hinges between the center section and the side sections and the side sections are folded upwardly about the living hinges to define the channel.

11. In a safety system for use with linearly arranged reinforcement bars including a plurality of safety covers, one for each linearly arranged reinforcement bar, each safety cover including a cover plate and a collar operatively associated with and extending downwardly from the cover plate for mounting to an upper end of one of the reinforcement bars, an adapter for supporting an elongate body above the linearly arranged reinforcement bars comprising:

a center wall connected to opposite upwardly turned side walls to define a channel, the channel for receiving an elongate body extending between two or more of the adapters on linearly arranged reinforcement bars; and securing means operatively associated with the center wall for removably securing the adapter to one of the safety covers.

12. The adapter of claim 11 wherein the securing means comprises a through opening in the center wall whereby the cover plate of one of the safety covers is disposed in the channel and the collar extends downwardly through the opening to removably securing the adapter to one of the safety covers.

13. The adapter of claim 11 wherein the securing means comprises opposite support members extending downwardly from the center wall and the cover plate of one of the safety covers is supported between the support members to removably securing the adapter to one of the safety covers.

14. The adapter of claim 11 wherein the sidewalls include a plurality of openings for receiving fasteners to fasten the elongate body to the adapter.

15. The adapter of claim 14 wherein the side walls include inwardly extending bosses surrounding each opening.

16. The adapter of claim 11 wherein each adapter includes tabs hingedly mounted to and extending upwardly from the side walls for attaching to a top of the elongate body.

17. The adapter of claim 11 wherein the side walls include inwardly extending ribs.

18. The adapter of claim 11 wherein the center wall includes upwardly extending pins receivable in openings in the cover plate to snap fit the adapter to one of the safety covers.

19. The adapter of claim 11 wherein each adapter is of one piece plastic construction.

20. The adapter of claim 11 wherein the adapter comprises a generally planar elongate plate having a pair of laterally extending grooves to define living hinges between the center wall and the side walls and the side walls are folded upwardly about the living hinges to define the channel.

* * * * *